United States Patent [19]

Podolan et al.

[11] 4,068,407

[45] Jan. 17, 1978

[54] SLIDING VEHICLE DOOR

[75] Inventors: Edward G. Podolan; Francis C. Przybysz, both of Utica; Thadius F. Jozefczak, Warren, all of Mich.

[73] Assignee: General Motors Corporation, Detroit, Mich.

[21] Appl. No.: 728,552

[22] Filed: Oct. 1, 1976

[51] Int. Cl.[2] ..... E05D 15/10

[52] U.S. Cl. ..... 49/215; 49/218

[58] Field of Search ..... 49/209, 215, 216, 217, 49/218, 221, 212, 213, 222, 223, 224, 225

[56] References Cited

U.S. PATENT DOCUMENTS

| | | | |
|---|---|---|---|
| 3,484,993 | 12/1969 | Erb et al. | 49/216 |
| 3,501,864 | 3/1970 | Erb et al. | 49/215 |
| 3,520,083 | 7/1970 | Erb et al. | 49/218 X |
| 3,935,674 | 2/1976 | Williams et al. | 49/216 X |

*Primary Examiner*—Philip C. Kannan

*Attorney, Agent, or Firm*—K. H. MacLean, Jr.

[57] ABSTRACT

A swingable and slidable vehicle door assembly opened by an initial laterally outward swinging movement followed by a sliding movement along the exterior side of the vehicle. The vehicle door assembly is supported at three points with a suspension mechanism on the leading edge combined with a lateral guide mechanism to produce the aforementioned lateral movement of the door, followed by sliding movement. A pivotal support member is mounted on the side of the door opening adjacent the door's leading edge and has rollers mounted thereon adapted to engage track means on the door. The pivotal member rotates from an initial closed-door position characterized by substantial fore and aft alignment with the plane of the door to a laterally outward position, thereby moving the leading edge of the door laterally outward from the vehicle body to permit subsequent sliding movement. The rollers are rotatable about vertical axes and one engages a cam plate member to direct the initial swinging movement of the pivotal member and subsequently enters the door track to permit the door to slide along the vehicle body.

3 Claims, 11 Drawing Figures

SLIDING VEHICLE DOOR

The subject invention concerns vehicle doors, and particularly a vehicle door characterized by an initial swinging movement to place the door laterally outward from the body, followed by sliding movement along the body.

Sliding doors on vehicles are normally used for providing access to the vehicle interior through a relatively elongated opening in the vehicle leading to both forward and rearward portions of the vehicle. Consequently, the sliding door is invariably of greater size than more conventional hinged doors commonly used in most present day vehicles. The weight of the large sliding door presents unique support considerations. The present invention provides a compact and simple support mechanism utilizing a simple three-point suspension, as compared with known multi-point suspensions utilizing four or five support means. This three-point suspension is desirable in that alignment problems are minimized and the movement of the door outward and subsequently along the vehicle body takes place with minimal effort. Many of the prior sliding door assemblies utilizing more than three supports for a door increase the probability of undesirable misalignment and resultant binding of the door followers in the guide tracks.

As compared to the compact, simple and effective door mechanism illustrated and described hereinafter, a more complicated and potentially troublesome door mechanism is disclosed in U.S. Pat. No. 3,484,993 to Erb et al. In the Erb patent, a swinging and sliding door is supported at the trailing edge by an arm 10 which follows a track on the vehicle body. The door is supported at the leading edge by a link 3 midway between the upper and lower portions of the door. In addition, the door support includes a member 17 with arms engaging tracks in the door. Thus, the leading edge of the door is supported by members engaging four tracks. This arrangement, in addition to being complicated and costly, is sensitive to normally occurring slight misalignments between the arms and tracks. In order for the Erb door to open and close with a light operator effort, the tracks would have to be in almost perfect parallelism. Any misalignment during the assembly process would surely produce some binding or sticking of the door necessitating a large opening effort. Another problem with the Erb arrangement is the provision of tracks formed in the vehicle body at the beltline, including an elongated opening extending from a location adjacent the leading edge of the door to a position remote from the door and approximating the length of the door. This arrangement is unsightly and provides breaks in the vehicle body subject to damage from impact, as well as from the elements.

The subject swinging and sliding door is supported at the trailing edge by an arm member which supports rollers. The rollers follow a track formed along the bottom edge of the door opening. The leading edge of the door is vertically supported and guided laterally by rollers on a pivotal link member. The pivotal link member is mounted on the vehicle body adjacent the vertical edge of the door opening and near the leading edge of the door it is in a closed operative position. During opening of the door, the pivotal link member moves from a generally fore and aft orientation about a vertical axis, and the leading edge of the door is moved laterally outward so as not to interfere with the vehicle body during its subsequent sliding movement. The pivotal member has upper and lower arms, one of which supports the door vertically by rollers rotatable about a horizontal axis and which are adapted to engage a track in the door.

The other arm of the pivotal member has first and second spaced rollers rotatable about a vertical axis which also engages a track in the door. These rollers guide the door in its initial lateral movement with respect to the body. When the door is in its closed position, the first and second rollers are oriented laterally from one another with the first roller in the door track and the second roller laterally spaced therefrom. A cam plate having a curved surface engages the second roller and thereby produces the pivotal movement of the link member which causes the leading edge of the door to move laterally from the vehicle body. After the initial lateral movement of the door, the second roller is oriented in a fore and aft direction with the first roller and it also enters the door track. Thereafter, the door may be slid along and parallel to the vehicle body to its open position. During this sliding movement, the pivotal link member remains in its laterally extending position.

Therefore, an object of the present invention is to provide a simple and compact support mechanism for a swingable and slidable vehicle door supported at its trailing edge by a single first support and at its leading edge by vertically spaced second and third supports, one of the second and third supports guiding the leading edge of the door in its initial lateral movement away from the vehicle body with the other providing vertical support.

A further object of the present invention is to provide a simple and compact swinging and sliding vehicle door support system utilizing an arm support attached to the trailing edge of the door adapted to follow a track formed adjacent the lower edge of the door opening and with roller means supporting the leading edge of the door and mounted on both of two arms of a pivotal member which, in an opening sequence, first swings the leading edge of the door laterally away from the vehicle body and subsequently guides the door as it is slid along and generally parallel to the vehicle body to expose an opening to the vehicle interior.

Further objects and advantages of the present invention will be more readily apparent from the following detailed description, reference being had to the accompanying drawings, in which a preferred embodiment is illustrated.

IN THE DRAWINGS

FIG. 3 is a fragmentary view looking down on the vehicle along view line 3—3 in FIG. 1 and looking in the directionof the arrows;

Figure 1:
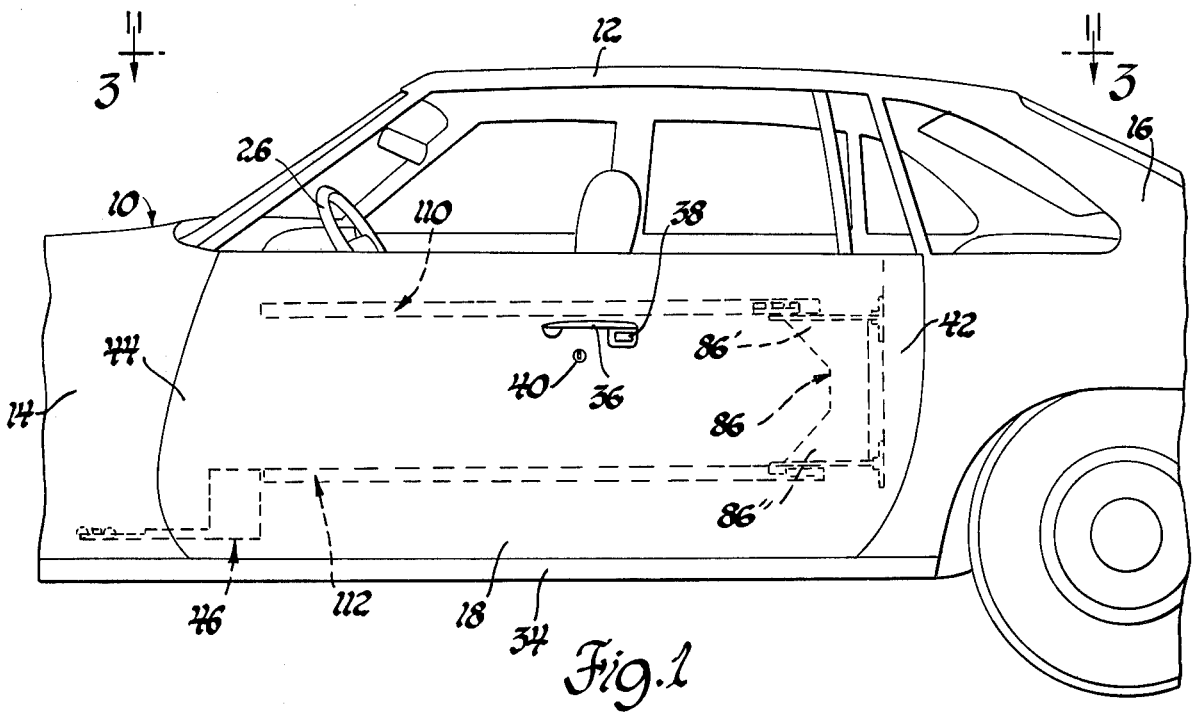
FIG. 1 is a fragmentary elevational view of a vehicle showing the subject sliding door in a closed operational position.
Figure 2:
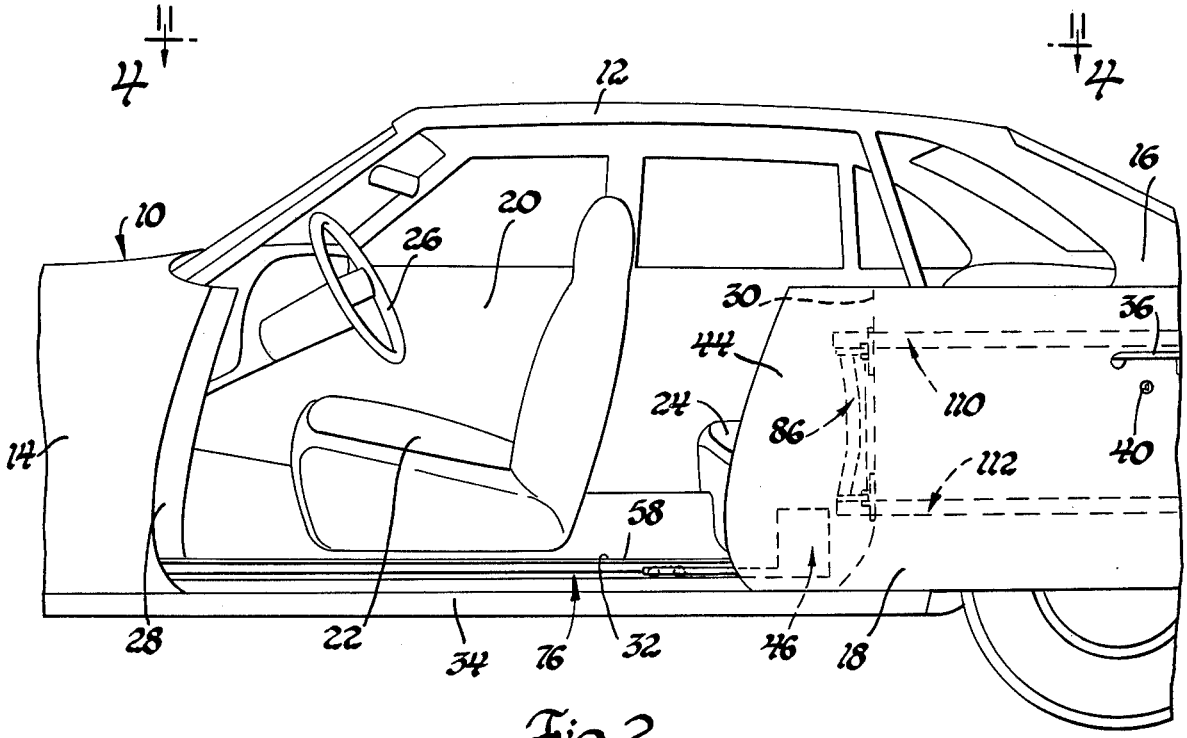
FIG. 2 is a figure like FIG. 1 but with the door in an open operational position.

In FIGS. 1 and 2, a vehicle 10 is illustrated which includes a roof portion 12, a forward side body portion 14, a rearward side body portion 16 and a side door 18. The door 18 is illustrated in its closed operative position in FIG. 1 and in an open position in FIG. 2. Door 18 encloses a passenger or interior compartment 20 in which forward and rear seats 22, 24 are mounted. A steering wheel 26 is conventionally located in the forward part of the passenger compartment 20 in front of seat 22.

In a closed position, door 18 fills the opening formed between a forward pillar 28, a rearward pillar 30 and a bottom edge portion 32, which is formed immediately above and integral with a rocker panel 34. The door 18 has a handle 36, opening member 38 and lock cylinder 40 therein to facilitate the operation of the door. As is evident from FIGS. 1–4, the door 18 is not a conventionally hinged pivotal door but is a swinging and then sliding door which is particularly well adapted to permit passengers to enter both the forward and rearward portions of the passenger compartment 20. Door 18 initially moves from its closed position laterally outward at the leading edge portion 42 and then slides rearward as the trailing edge portion 44 moves to the right in FIGS. 1, 2 to provide access to compartment 20.

Figure 5:
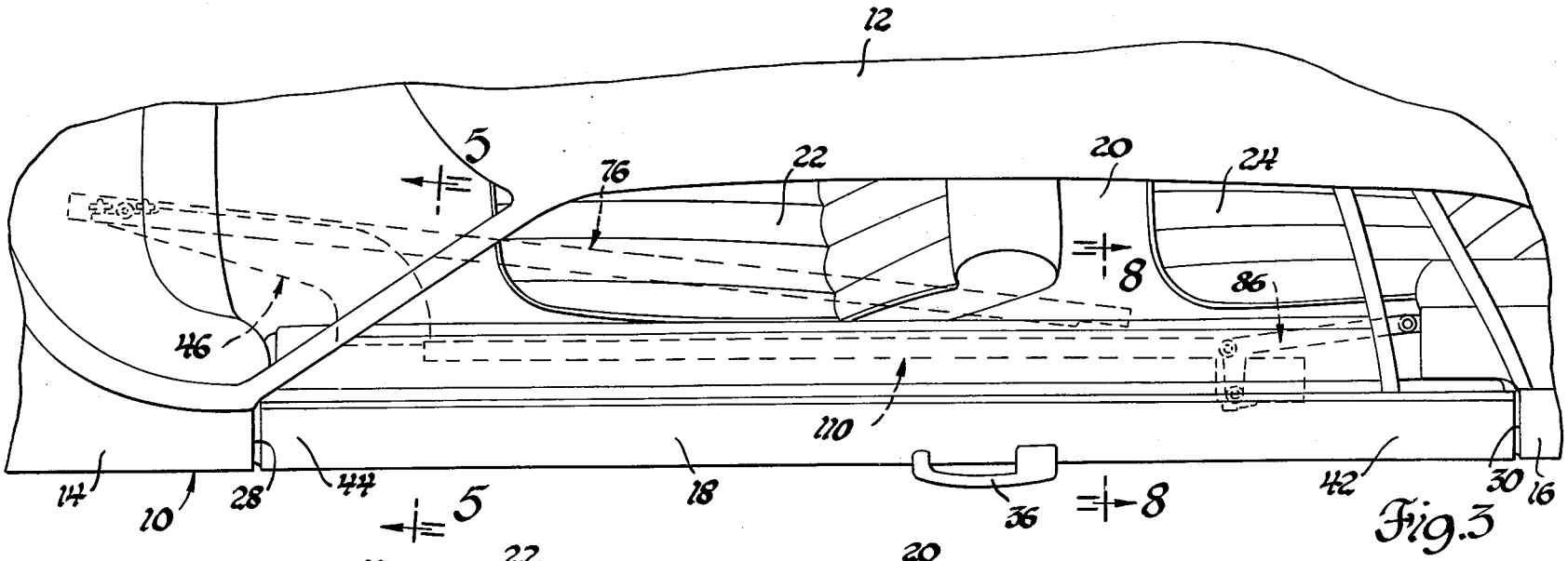
FIG. 5 is a sectional view taken along section line 5—5 in FIG. 3 and looking in the direction of the arrows.
Figure 4:
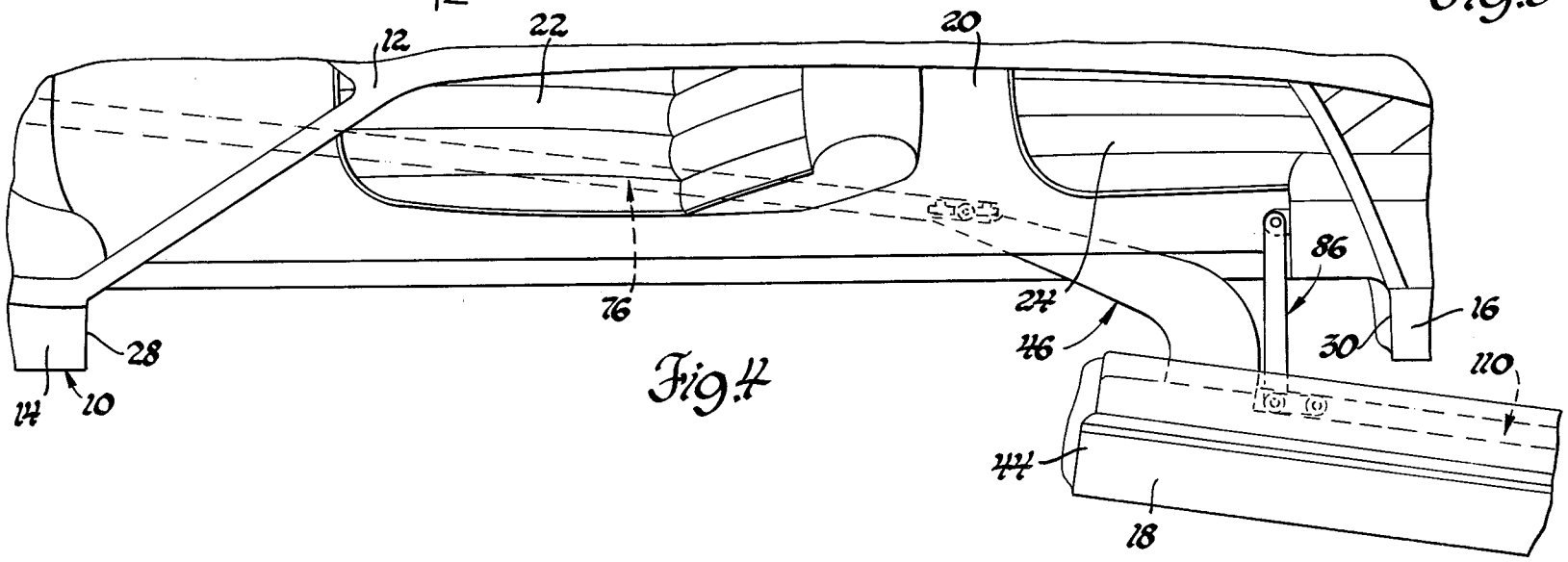
FIG. 4 is a fragmentary view of the vehicle like FIG. 3 taken along view line 4–4 in FIG. 2 and looking in the direction of the arrows.
Figure 5:
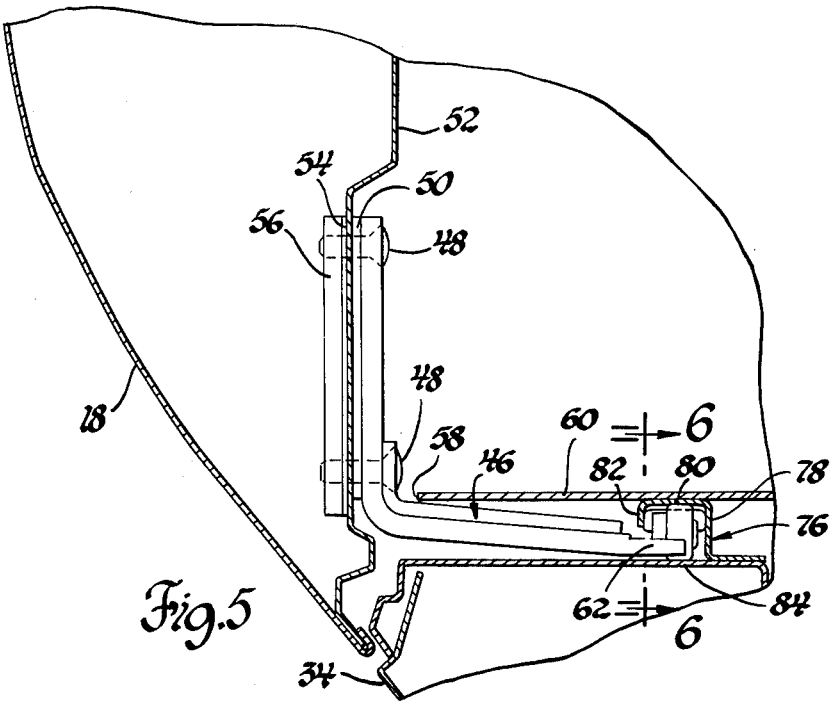
Figure 6:
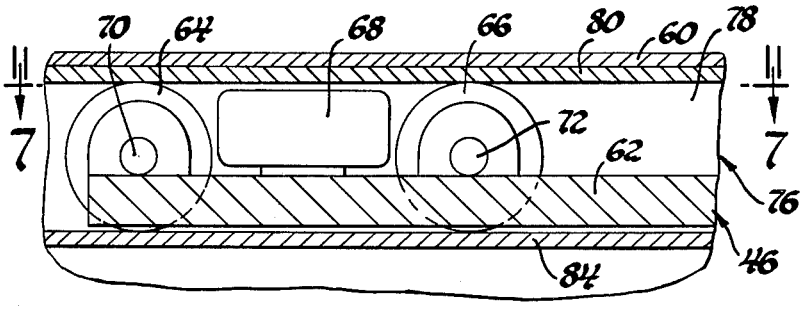
FIG. 6 is a sectional view taken along section line 6—6 in FIG. 5 and looking in the direction of the arrows.
Figure 7:
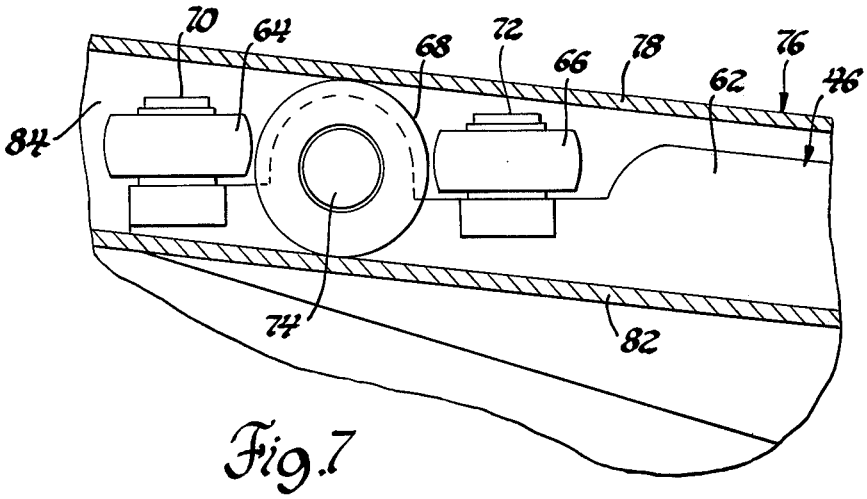
FIG. 7 is a sectional view taken along section line 7—7 in FIG. 6 and looking in the direction of the arrows.

The door 18 is supported in a vertical direction at the trailing edge 44 by an assembly including an arm 46, as best shown in FIG. 5. Arm 46 is attached by fasteners 48 which extend through a plate 50, the inner door panel 52 and plates 54, 56. The other end of the arm 46 extends through an elongated opening 58 formed between rocket panel 34 and the floor 60 of the passenger compartment 20. As shown in FIGS. 5, 6, 7, the end 62 of arm 46 supports three roller followers 64, 66, 68. Rollers 64, 66 are supported for rotational movement about shafts 70, 72 whose axes extend horizontally. Roller follower 68 is supported upon a shaft 74 whose axis extends vertically. The roller followers 64, 66 and 68 engage and are enclosed by a generally U-shaped track 76 formed by an inner wall portion 78, an upper wall portion 80 and an outer wall portion 82. Rollers 64, 66 rest against member 84, as shown in FIG. 5, to support the trailing edge of the door both vertically and laterally with respect to the body of the vehicle. The roller 68 engages the inner and outer wall portions 78, 82 to guide the lateral movement of the trailing edge of the door. As can be seen in FIGS. 3, 4, the track member 76 extends in a fore and aft direction of the vehicle and extends more laterally inward at the forward end than at the rearward end. Thus, as the rollers 64, 66 and 68 follow track 76, the trailing edge 44 of door 18 moves both rearward and laterally outward from the vehicle body.

Figure 8:
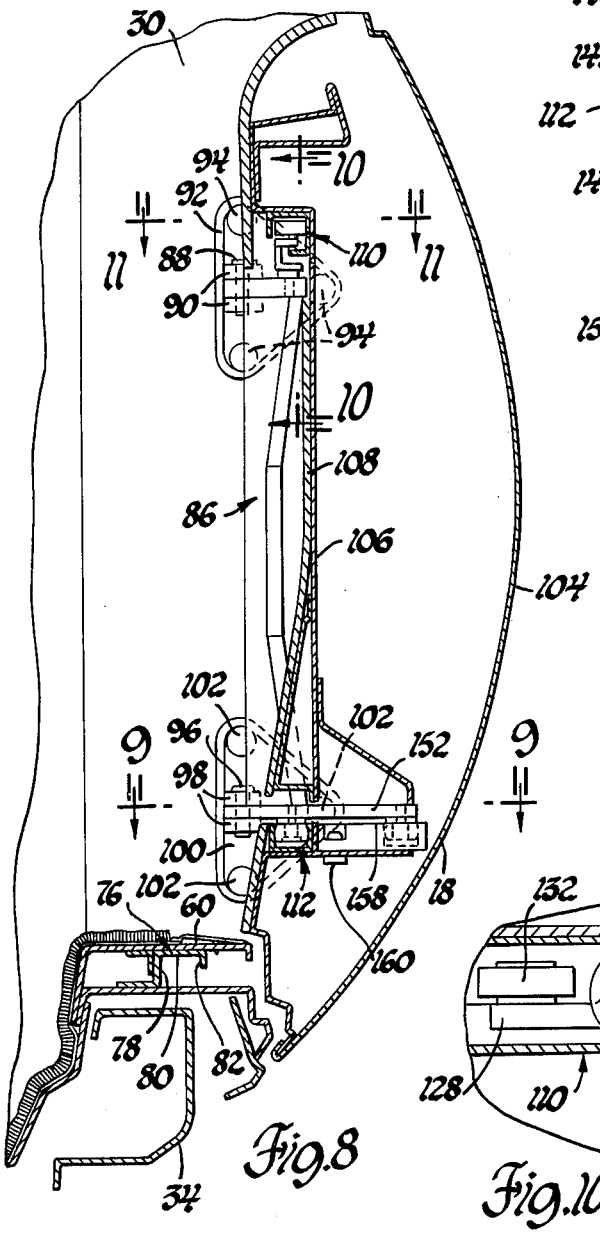
FIG. 8 is a sectional view of the door taken along section line 8—8 in FIG. 3 and looking in the direction of the arrows.

The leading edge 42 of the door 18 as shown in FIGS. 1–4 is supported by a pivotal arm or line member 86. The member 86 is mounted to the rear pillar portion 30 of the opening in the vehicle 10. As can be seen in FIG. 8, member 86 is supported at an upper end for pivotal movement about a pin 88 extending through outwardly extending portions 90 from a plate 92 attached to the rear pillar 30 by fasteners 94. Likewise, the lower end of member 86 is fastened to portion 30 by a pin 96 which extends through portions 98 on plate 100 attached to the body by fasteners 102.

Member 86, as shown in FIG. 1, has an upper arm portion 86′ and a lower arm portion 86″. The upper and lower arms of member 86 generally extend in a fore and aft direction when the door is in a closed operative position, as seen in FIG. 3. The arm 86 is pivoted by opening movements of the door to a laterally outward position shown in FIG. 4, which moves the leading edge 42 of door 18 away from the body portion 16 so the door may subsequently slide to its open position shown in FIG. 2.

Figure 10:
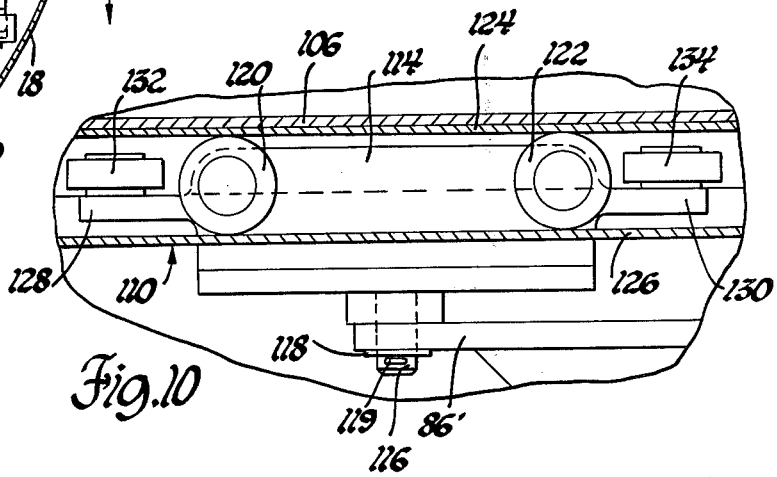
FIG. 10 is a sectional view taken along section line 10—10 in FIG. 8 and looking in the direction of the arrows.
Figure 11:
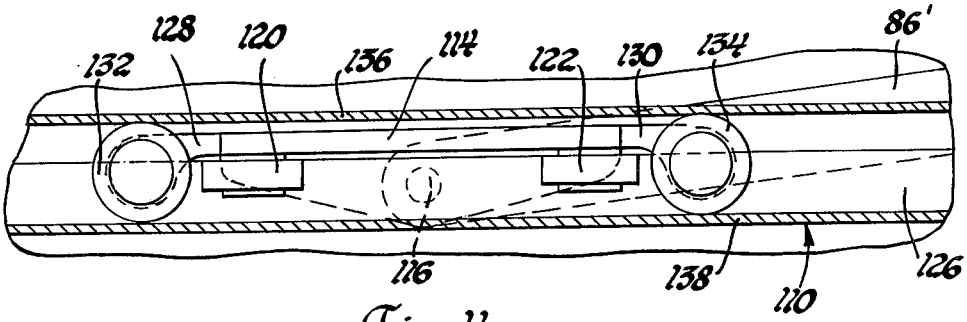
FIG. 11 is a sectional view taken along section line 11—11 in FIG. 8 and looking in the direction of the arrows.

The door 18 as best shown in FIG. 8 includes an outer panel 104 and an inner panel 106 covered by a decorative member 108. As shown in FIGS. 1 and 8, parallel upper and lower tracks 110, 112 are attached to the inner panel 106 of the door. Tracks 110, 112 extend substantially the entire length of the door 18 and are engaged by follower means on the end of the upper and lower arm 86′, 86″ to guide the door in its sliding and swinging movement. Specifically, the follower mechanism supported on the upper portion 86′ is illustrated in detail in FIGS. 10, 11. A carriage member 114 is pivotally attached to the upper arm 86′ by a pin member 116 which extends through a bore in the arm 86′. A washer 118 and cotter pin 119 secure the carriage 114, while permitting it to pivot on the arm 86′. The carriage 114 includes support for two rollers 120, 122 having their axes extending in a horizontal plane so that the rollers 120, 122 are between the upper wall 124 and the lower wall 126 of the track 110. Rollers 120, 122 support the leading edge of the door 18 in a vertical direction and run generally parallel to the lower track 76 which guides the trailing end of the door. Carriage 114 also has projections 128, 130 which support rollers 132 and 134 with vertical axes for contact with the inner wall portion 136 and the other wall portion 138 of the track 110. These guide the lateral movement of door 18 during the initial opening movement as the member 86 pivots laterally outward.

Figure 9:
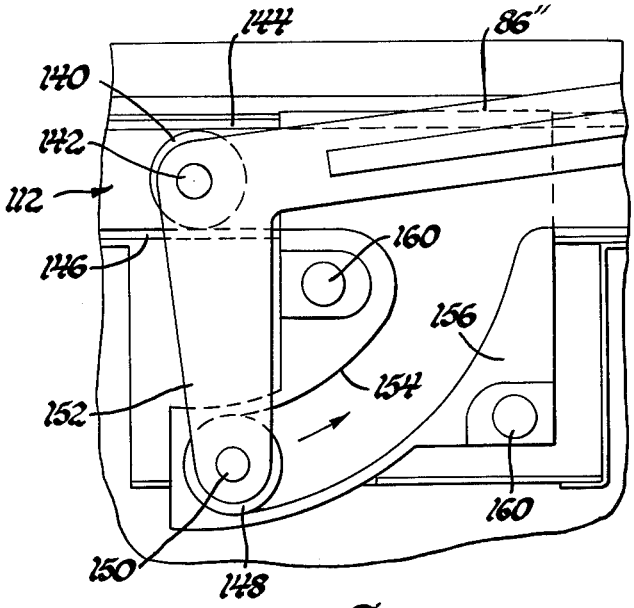
FIG. 9 is a sectional view taken along section line 9—9 in FIG. 8 and looking in the direction of the arrows.

The lower portion 86″ of arm 86 also supports roller followers to guide door 18 in its initial movement. In FIGS. 8 and 9, lower portion 86″ is shown supporting a roller 140 near its end. Roller 140 rotates on a vertically oriented shaft 142 and contacts the inner and outer sides 144, 146 of track 112. A second roller 148 is supported for rotation on a vertically oriented shaft 150 which is mounted to an offset portion or arm 152 of the lower arm 86″. Arm portion 152, when the door is in the closed operative position, extends laterally outward from the body, as shown in FIG. 8. The roller 148 moves within an arcuate curve channel 154 formed in a cam plate member 156. Cam plate 156 is attached to an outwardly extended portion 158 of the inner door panel 106 by fasteners 160 which extend upward through the portion 158 in the cam plate. As the door handle 36 is pulled outward and rearwardly, the arm 86 is pivoted laterally outward from the vehicle while the roller 148 traces the curve of channel 154 in the direction of the arrow in FIG. 9. When the arm 86 is pivoted fully outward as in FIG. 4, the roller 148 enters the end of track 112. In this fully swung position, the axis of channel 112 and the line joining the centers of rotation of rollers 140 and 148 are parallel and thereafter the door may be slid backward.

Although the embodiment illustrated as described above is a preferred embodiment, other embodiments are contemplated still falling within the scope of the following claims which define the invention.

What is claimed is as follows:

1. Support and guide mechanism for a swingable and slidable door assembly of a vehicle adapted to cover a body opening defined between forward and rearward pillars and between an upper roof edge portion and a lower body edge portion, comprising: extended arm means attached to one end portion of the door and with a portion engaging a track formed in the vehicle body; said track extending along said opening and curving laterally inward at one end so that said one end portion of the door is located flush with an adjacent pillar portion of the body when in a closed operative position; a link arm supporting the other end portion of said door and mounted on the other pillar member; said link arm mounted for pivotal movement about a substantially vertical axis from a closed door position in which the link arm is in a generally fore and aft orientation to an open door position in which the link arm projects laterally outward from the vehicle body; first and second tracks formed in the vehicle door in a generally horizontal plane; said link arm having upper and lower projecting portions; a roller carriage member supported on the end of one of said projecting portions and mounted to permit rotation about a vertical axis; rollers supported by said carriage for rotation about both horizontal and vertical axes for engagement with one of said tracks in said door; a pair of spaced pivot and guide rollers mounted on the end of the other projecting portion of said link arm and pivotal about generally vertical axes; the first of said spaced rollers mounted in line with the axis of the projecting portion and the second of said spaced rollers being offset mounted so as to be spaced laterally outward from the first spaced roller when the link member is in a closed operative position whereby the first and second spaced rollers move into alignment with each other and the other of said door-mounted tracks as the pivotal link arm swings laterally outward from its closed door operative position; a cam plate supported by said door adjacent the end of said other door-mounted track and having curved guide surface extending in substantial horizontal orientation and opening to the other door-mounted track, said second spaced roller engaging said guide surface during swinging movement of said link arm from the laterally outward orientation of said second roller with respect to said first roller when the door is closed to the aligned orientation between said rollers and said other door-mounted track when said door is opening by movement of both rollers through said other door-mounted track.

2. In a vehicle having an access opening in the body covered by a door assembly and defined between vertical pillar members and upper and lower edge portions, a support and guide mechanism to produce initial swinging movement of the leading portion of the door as it is opened followed by sliding movement along the exterior of the vehicle body, the mechanism comprising: an arm attached to the trailing end portion of said door and extending laterally inward; a track formed adjacent the lower edge portion of the body operably engaging the end of said arm to support and guide the trailing end portion of the door in its opening movement; said track curving laterally inward at one end so that said one end portion of the door is located flush with an adjacent pillar portion of the body when in a closed operative position; a dual-armed member engaging the other end portion of the door at two locations and mounted for pivotal movement on the other pillar member; one arm of the pivotal armed member supporting a carriage member in a manner permitting rotation about a vertical axis; said carriage supporting rollers rotatable about both vertical and horizontal axes; two parallel tracks extending horizontally in said door; said carriage-mounted rollers engaging horizontal and vertical surfaces of one of said door tracks for both lateral spacing of the leading end portion of the door and for support; a pair of spaced roller guides rotatable about vertical axes on the end of the second arm of the pivotal dual-armed member; the first of said roller guides being substantially in line with the axis of said second arm and engaging the other door track during opening and closing movement of the door; the second roller guide being mounted offset from the axis of the second arm and being laterally outward from the first roller guide when the door is in the closed operative position; a cam plate supported by said door adjacent the end of said other door- mounted track and having curved guide surface extending in substantial horizontal orientation and opening to the other door-mounted track, said second spaced roller engaging said guide surface during swinging movement of said link arm from the laterally outward orientation of said second roller with respect to said first roller when the door is closed to the aligned orientation between said rollers and said other door-mounted track when said door is opening by movement by both rollers through said other door-mounted track.

3. A swinging and sliding vehicle door assembly for a vehicle body which has an elongated opening formed therein define between forward and rearward pillar members and between an upper roof edge portion and a lower edge portion of the body, comprising: an elongated door having spaced inner and outer panel portions and covering said elongated opening when in a closed operative position; a first end portion of said door adjacent said forward pillar member having an arm extending therefrom in a forward and laterally inward direction from the lower forward corner of the door; first follower means on the free end of said arm, including a roller rotatable about a horizontal axis and another roller rotatable about a vertical axis; a track in said body extending generally parallel to the lower edge portion of the body and including horizontal and vertical surfaces operably engaging the rollers having a horizontal axis and vertical axis, respectively, a portion of said track extending adjacent said forward pillar member being located more laterally inward than the remainder of the track, whereby the arm-mounted roller followers position the first edge portion of the door laterally inward as the door closes, thereby aligning the door and pillar member when the door is in a closed operative position; a pivotal link arm member mounted about a vertical axis on said rearward pillar of said body and having upper and lower projecting arm portions extending therefrom; carriage means pivotally supported about a vertical axis on the end of one of said link arm portions; said carriage having at least one roller mounted thereon for rotation about a horizontal axis and at least one roller supported for rotation about a vertical axis; a first track supported by said door adjacent said inner panel and adapted to engage said carriage-mounted rollers to laterally position and support said door; the other link arm portion having a first roller mounted about a vertical axis substantially in line with the axis of said link arm; a second track supported by said door and substantially parallel to said first track and having vertical surfaces adapted to engage said first roller forming a pivotal connected between the other link arm portion and said door during the initial swinging movement; a second roller mounted on the other link arm portion but with its vertical axis laterally offset from the axis of the other link arm portion; a horizontally oriented flat cam plate supported by said door adjacent the end of said second track and having an arcuate guide surface engaged by said second roller during the initial opening of the door, whereby as the door is pulled initially outward and rearward, said pivotal link member swings laterally outward, whereby the second roller traces the arcuate guide surface of said cam plate until a line extending between the centers of rotation of said first and second rollers in aligned with said second track and subsequent further movement of said door is by movement of said first and second rollers in said second track, thereby locking the pivotal link in a laterally outwardly extended position.

* * * * *